US005635303A

United States Patent [19]

Retallick

[11] Patent Number: 5,635,303

[45] Date of Patent: Jun. 3, 1997

[54] ALUMINIDE FOR USE IN HIGH-TEMPERATURE ENVIRONMENTS

[76] Inventor: William B. Retallick, 1432 Johnny's Way, West Chester, Pa. 19382

[21] Appl. No.: 607,174

[22] Filed: Feb. 26, 1996

[51] Int. Cl.[6] ..... B22F 7/04

[52] U.S. Cl. ..... 428/472.2; 427/399; 428/651; 148/253; 416/241 R; 416/241 B

[58] Field of Search ..... 427/399; 148/253; 428/472.2, 651, 241 R; 416/24 B

[56] References Cited

U.S. PATENT DOCUMENTS 2,926,123 2/1960 Simon ..... 148/253

3,176,933 4/1965 Clemmons ..... 148/253

4,718,482 1/1988 Iwama ..... 148/253

*Primary Examiner*—Sam Silverberg

*Attorney, Agent, or Firm*—William H. Eilberg

[57] ABSTRACT

The surface of an aluminide is treated to make it less chemically reactive. In particular, this treatment inhibits oxidation of the aluminide at high temperatures. According to the invention, one coats the aluminide with a solution that containing phosphoric or phosphorous acid, and then one heats the aluminide, so as to calcine the coating. The phosphoric or phosphorous acid reacts with the aluminide to form a surface that resists oxidation. One can use this process to coat the blades of a gas turbine, or to coat other aluminide structures intended for use in high-temperature environments.

22 Claims, 6 Drawing Sheets

WEIGHT GAIN gm/in2
.100
.090
.080
.070
.060
.050
.040
.030
.025
.020
.015
.010
.009
.008
.007
.006
.005
.004
.003
.0025
.002
.0015
.001
100
150
200
250
300
400
500
600
700
800
900
1000
1500
2000
2500
3000
4000
5000
6000
7000
MINUTES ON TEST
TEST 9 - o
TEST 13 - ⊙
TEST 14 - △
TEST 15 - +

ALUMINIDE FOR USE IN HIGH-TEMPERATURE ENVIRONMENTS

BACKGROUND OF THE INVENTION

The present invention provides a treatment for aluminides which makes the aluminides better suited for use in high-temperature environments.

As a means of saving weight, the blades of gas turbines can be made of aluminides. The incentive to save weight in aircraft turbines is obvious. Even in stationary ground-based turbines, there is an incentive to make the blades of aluminides. The turbine rotates on bearings which do wear eventually. After the bearings begin to wear, the mass of the rotor begins to precess, which further accelerates the wear of the bearings.

The weight saving due to the use of aluminides is considerable; the density of titanium aluminides is only about half the density of the superalloys used for turbine blades.

A gas turbine engine comprises a compressor and a turbine. In the compressor, the air for combustion is compressed to the pressure at which the fuel is injected and combustion takes place. In advanced turbines, the compression ratio is as high as 30, and the temperature of the compressed air entering the combustor reaches about 800° K. or about 530° C. Oxidation is not a serious problem at this temperature, so it is not essential that the surface of the compressor blade be particularly resistant to oxidation.

The temperature of the combustion gas entering the turbine can reach 1300° C. in advanced turbines. This temperature is much too high for aluminides, even when treated to make them resistant to oxidation. Turbine exhaust temperatures are much lower. The turbine exhaust temperature is about 680° C. for the Concorde in supersonic flight and as low as 500° C. for stationary turbines. Thus, it is possible to use aluminide blades in the later stages of the turbine.

The present invention provides a treatment for the aluminide blades which makes it possible to introduce such blades into the hotter stages of the turbine.

SUMMARY OF THE INVENTION

According to the present invention, one selects a particular aluminide, and coats the aluminide with a water solution of phosphoric acid or phosphorous acid. Then the coated aluminide is dried and calcined. The phosphorus containing acid reacts with the aluminide to render the surface of the aluminide less reactive. The weight of the coating applied to the aluminide is about 0.003 to 0.006 gm/in$^2$. In a preferred embodiment, the aluminide is given a single coating of commercial concentrated (85%) phosphoric acid and calcined at about 500° C.

The present invention therefore has the primary object of providing a method of rendering an aluminide less reactive.

The invention has the further object of providing a composition of matter comprising an aluminide having a surface of reduced reactivity.

The invention has the further object of providing an aluminide having a surface which resists oxidation.

The invention has the further object of making feasible the use of aluminides in high-temperature environments, such as in gas turbines.

The invention has the further object of enhancing the efficiency of gas turbines, and the like, due to the use of aluminides instead of much heavier metals.

The reader skilled in the art will recognize other objects and advantages of the present invention, from the brief description of the drawings, the detailed description of the invention, and the appended claims.

DETAILED DESCRIPTION OF THE INVENTION

Figure 1:
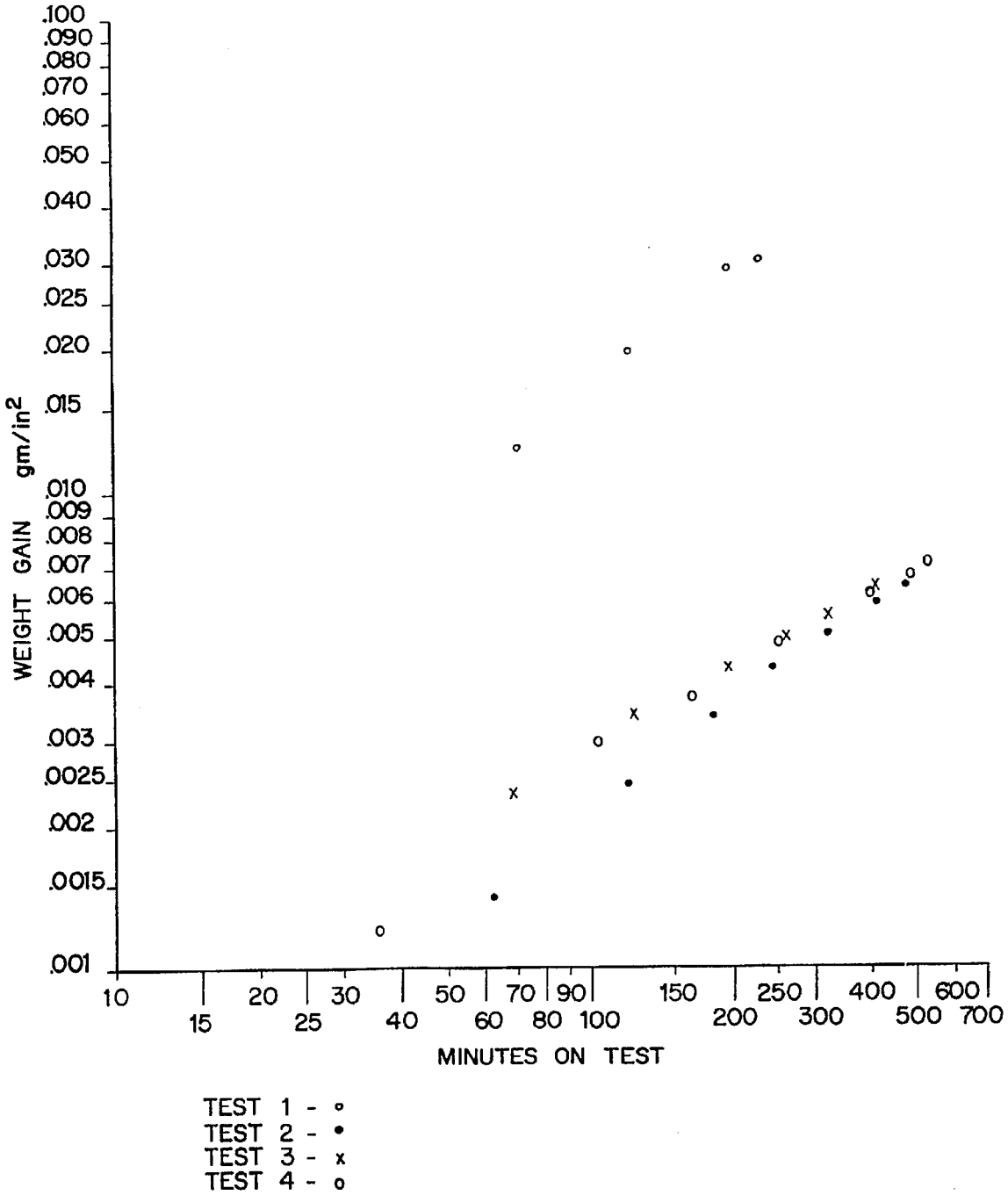
FIGS. 1–6 provide graphs showing the results of the tests described below, which tests demonstrate the properties of an aluminide treated according to the present invention.

The present invention treats an aluminide by coating it with phosphoric or phosphorous acid, and then by drying and calcining the coated aluminide. The result is a product having a surface which is less chemically reactive, and which therefore resists oxidation, even at high temperatures. After calcining, the aluminide acquires a coating which adheres tightly to the aluminide.

The following is a detailed description of the procedure for making the coated aluminide of the present invention, and for testing several candidate coatings.

The test pieces were made of titanium aluminide having the following composition:

| | Wt. % |
|---|---|
| Cobalt | 4.5 |
| Niobium | 4.5 |
| Chromium | 2.5 |
| Iron | 0.15 |
| Oxygen | 0.15 |
| Aluminum, about | 33 |
| Titanium | balance |

The composition described above is a gamma aluminide, having the nominal composition TiAl. Another titanium aluminide is the alpha aluminide, having the nominal composition $Ti_3Al$. Nickel aluminides, $Ni_3Al$ and NiAl are also used in turbines. This invention applies to all such aluminides.

The test pieces were made from a melt by sucking the melt up into a mold with a vacuum. Some of the test pieces were flat plates 2–3 mm thick. Some test pieces had irregular shapes.

For the irregularly shaped test pieces, the surface area to be coated was measured in the following way. The shape of the plate was reproduced on paper with the copying machine. Then, the shape was cut out and weighed and the area was calculated from the weight of the paper. For the test pieces having more regular shapes, such as that of a prism or a section of a blade, the area could be calculated directly from measured dimensions.

Before a coating was applied, the test piece was cleaned by grit blasting. The grit is crushed hard alumina with sharp edges. Grit blasting removes any dirt, oil, or oxide. Grit blasting also removes the coating from a tested piece so that the piece can be re-coated and tested again.

The coating began as a water solution of phosphoric acid. One or more coats were applied to the surface of the test piece with a brush, and each coating was dried and calcined. The drying temperature was about 150° C., only high enough to evaporate the water from a dilute solution. The calcining temperature was 500° C. or higher. A temperature of 500° C. is high enough to make each coating insoluble so that none of it is removed when the next coating is applied.

After the final coating was applied and calcined, the test piece was heated to 1000° C., and the strip was weighed as the temperature approached 1000° C. At first, the weight decreased slightly as the last water and unreacted phosphoric acid were evolved. At about 1000° C., the weight began to increase as the rate of oxidation of the aluminide surface become measurable. This sequence is illustrated by the following weights which describe an actual test:

| Minutes of Heating | Temp °C. | Weight of Test Piece, gm |
|---|---|---|
| 7 | 700 | 25.6354 |
| 14 | 800 | 25.6336 |
| 20 | 960 | 25.6292 |
| 28 | 1000 | 25.6286 |
| 43 | 1000 | 25.6346 |

At 43 minutes, the weight had started to increase. The "zero" time for the test occurred at minute 28. The weight gains would be measured relative to the minimum weight recorded at minute 28. After starting the time count at 1000° C., the temperature was increased to 1025° C. which became the target temperature for the duration of the test.

For each test there is given the weight of the initial coating. This weight is calculated from the minimum weight, which is the weight at minute 28 in the above example.

During a test, the time was noted when the test piece was taken out of the furnace and when the piece was returned to the furnace. These intervals are not included in the minutes recorded for each test.

The following sections describe various tests performed on test pieces, according to the present invention. The data obtained from these tests are summarized, interpreted, and displayed graphically, following the description of the tests.

Test No. 1

The coating was applied to just one side of the test piece. First, an alumina washcoat was applied and calcined, which deposited 0.018 gm/in$^2$ of calcined alumina. Then phosphoric acid was applied over the alumina which added 0.010 gm/in$^2$ after calcining.

| Minutes at 1000–1020° C. | Weight Gain, gm/in$^2$ |
|---|---|
| 71 | .0126 |
| 123 | .0196 |
| 196 | .0285 |
| 235 | .0304 |

During this procedure, the uncoated side was oxidized to a solid tan color. The coated side remained a mottled gray color. All of the weight gain is assigned to the uncoated side.

Test No. 2

The coating was the same as for Test No. 1, but this time it was applied to both sides of the strip. The results are shown below:

| Minutes on Test | Temperature °C. | Weight Gain, gm/in$^2$ |
|---|---|---|
| 10 | 1000 | .0002 |
| 33 | 1020 | .00084 |
| 63 | 1020 | .0014 |

-continued

| Minutes on Test | Temperature °C. | Weight Gain, gm/in$^2$ |
|---|---|---|
| 124 | 1010 | .0024 |
| 181 | 1020 | .0034 |
| 248 | 1020 | .0043 |
| 334 | 1020 | .0051 |
| 419 | 1020 | .0059 |
| 483 | 1020 | .0064 |

Test No. 3

In this test, one coats the test piece with four coatings of a solution containing equal weights of 85% phosphoric acid and water. The weight of the calcined coating was 0.0046 gm/in$^2$. The results are shown below:

| Minutes on Test | Temperature °C. | Weight Gain, gm/in$^2$ |
|---|---|---|
| 68 | 1040 | .0023 |
| 125 | 1030 | .0034 |
| 195 | 1025 | .0043 |
| 263 | 1025 | .0050 |
| 333 | 1025 | .0056 |
| 414 | 1025 | .0063 |

Test No. 4

The coating in this test comprised four coatings of a solution containing equal weights of 85% phosphoric acid and water. The weight of the calcined coating was 0.0057 gm/in$^2$. The results are shown below:

| Minutes on Test | Temperature °C. | Weight Gain, gm/in$^2$ |
|---|---|---|
| 36 | 1025 | .0012 |
| 104 | 1025 | .0030 |
| 164 | 1025 | .0038 |
| 254 | 1025 | .0049 |
| 405 | 1025 | .0062 |
| 483 | 1025 | .0068 |
| 538 | 1025 | .0072 |

Test No. 5

The coating in this test comprised five coatings of a solution containing 1.5 weight of 85% phosphoric acid and 1.0 weight of water. The weight of the calcined coating was 0.0070 gm/in$^2$. The results are shown below:

| Minutes on Test | Temperature °C. | Weight Gain, gm/in$^2$ |
|---|---|---|
| 24 | 1050 | .0009 |
| 83 | 1030 | .0028 |
| 169 | 1030 | .0044 |
| 310 | 1025 | .0064 |
| 406 | 1025 | .0073 |
| 460 | 1025 | .0077 |

Test No. 6

The coating in this test comprised two coatings of a solution containing equal weights of phosphorous acid and water. The weight of the calcined coating was 0.0031 gm/in$^2$. The results are shown below:

| Minutes on Test | Temperature °C. | Weight Gain, gm/in$^2$ |
|---|---|---|
| 10 | 1000 | .0002 |
| 26 | 1020 | .0006 |
| 52 | 1025 | .0011 |
| 75 | 1030 | .0014 |
| 106 | 1025 | .0019 |
| 144 | 1025 | .0023 |
| 541 | 1030 | .0073 |
| 591 | 1030 | .0079 |

Test No. 7

The coating in this test comprised two coatings of a solution containing 3.0 weight of 85% phosphoric acid and 1.0 weight of water. The weight of the calcined coating was 0.0036 gm/in$^2$. The results are shown below:

| Minutes on Test | Temperature °C. | Weight Gain, gm/in$^2$ |
|---|---|---|
| 6 | 1000 | .0001 |
| 21 | 1020 | .0005 |
| 40 | 1025 | .0009 |
| 65 | 1025 | .0013 |
| 109 | 1030 | .0021 |
| 209 | 1030 | .0033 |
| 291 | 1025 | .0039 |
| 412 | 1025 | .0046 |

Test No. 8

The test piece in this test had no coating at all. The results are shown below:

| Minutes on Test | Temperature °C. | Weight Gain, gm/in$^2$ |
|---|---|---|
| 8 | 1025 | .0031 |
| 33 | 1025 | .0071 |
| 77 | 1030 | .0121 |
| 177 | 1030 | .0202 |
| 259 | 1025 | .0238 |

Test No. 9

The coating in this test comprised one coating of undiluted (85%) phosphoric acid. The weight of the calcined coating was 0.0050 gm/in$^2$. The results are shown below:

| Minutes on Test | Temperature °C. | Weight Gain, gm/in$^2$ |
|---|---|---|
| 16 | 1000 | .0003 |
| 35 | 1025 | .00067 |
| 82 | 1025 | .0016 |
| 129 | 1030 | .0023 |
| 195 | 1030 | .0029 |
| 296 | 1025 | .0037 |
| 437 | 1025 | .0046 |
| 519 | 1025 | .0050 |
| 579 | 1025 | .0053 |
| 994 | 1025 | .0071 |
| 1421 | 1025 | .0094 |
| 1976 | 1025 | .0133 |
| 2637 | 1025 | .0171 |

Test No. 10

The coating in this test comprised two coatings of undiluted (85%) phosphoric acid. The weight of the calcined coating was 0.0063 gm/in$^2$. The results are shown below:

| Minutes on Test | Temperature °C. | Weight Gain, gm/in$^2$ |
|---|---|---|
| 10 | 1000 | .0000 |
| 34 | 1020 | .00066 |
| 48 | 1025 | .00090 |
| 91 | 1030 | .0018 |
| 146 | 1030 | .0029 |
| 298 | 1025 | .0049 |
| 342 | 1025 | .0053 |
| 600 | 1025 | .0076 |
| 690 | 1025 | .0084 |

Test No. 11

The coating in this test was formed by heating the test piece at 1025° C. for fifteen minutes, in air, to form an oxide coating weighing 0.0040 gm/in$^2$, and then by applying one coating of undiluted (85%) phosphoric acid. The weight of the calcined coating was 0.0030 gm/in$^2$, from the phosphoric acid. The results are shown below:

| Minutes on Test | Temperature °C. | Weight Gain, gm/in$^2$ |
|---|---|---|
| 12 | 1020 | .00033 |
| 51 | 1030 | .0012 |
| 128 | 1030 | .0030 |
| 219 | 1025 | .0047 |
| 320 | 1025 | .0066 |
| 379 | 1025 | .0076 |
| 523 | 1025 | .0098 |
| 564 | 1025 | .0105 |

Test No. 12

The coating in this test was formed by boiling the test piece in dilute nitric acid which removed 0.0024 gm/in$^2$, and then by coating the test piece once with undiluted (85%) phosphoric acid. The weight of the calcined coating was 0.0044 gm/in$^2$, from the phosphoric acid. The results are shown below:

| Minutes on Test | Temperature °C. | Weight Gain, gm/in$^2$ |
|---|---|---|
| 11 | 1025 | .00043 |
| 29 | 1025 | .0010 |
| 75 | 1025 | .0021 |
| 203 | 1025 | .0042 |
| 299 | 1025 | .0052 |
| 395 | 1025 | .0060 |
| 535 | 1025 | .0073 |
| 599 | 1025 | .0078 |

Test No. 13

The coating in this test comprised a solution containing 1.0 weight of undiluted phosphoric acid and 0.07 weight concentrated nitric acid. The weight of the calcined coating was 0.0027 gm/in$^2$. The results are shown below:

| Minutes on Test | Temperature °C. | Weight Gain, gm/in$^2$ |
|---|---|---|
| 30 | 1010 | .00027 |
| 45 | 1020 | .00091 |
| 67 | 1025 | .0013 |
| 118 | 1025 | .0020 |
| 236 | 1025 | .0029 |
| 321 | 1025 | .0033 |
| 589 | 1025 | .0045 |
| 778 | 1025 | .0053 |
| 1199 | 1025 | .0073 |
| 1626 | 1025 | .0096 |
| 2161 | 1025 | .0129 |
| 2822 | 1025 | .0171 |

Test No. 14

The coating in this test comprised a solution containing 1.0 weight of undiluted phosphoric acid and 0.28 weight concentrated nitric acid. The weight of the calcined coating was 0.0043 gm/in$^2$. The results are shown below:

| Minutes on Test | Temperature °C. | Weight Gain, gm/in$^2$ |
|---|---|---|
| 20 | 1025 | .00033 |
| 51 | 1025 | .0010 |
| 116 | 1040 | .0023 |
| 221 | 1025 | .0034 |
| 420 | 1025 | .0046 |
| 629 | 1025 | .0055 |
| 1063 | 1025 | .0070 |
| 1356 | 1025 | .0080 |
| 1909 | 1025 | .0099 |
| 2742 | 1025 | .0124 |
| 3230 | 1025 | .0138 |
| 3245 | 1025 | .0139 |
| 3942 | 1025 | .0164 |

Test No. 15

The coating in this test comprised two coatings of a solution containing 1.0 weight of undiluted phosphoric acid and 0.16 weight concentrated nitric acid. The weight of the calcined coating was 0.0055 gm/in$^2$. The results are shown below:

| Minutes on Test | Temperature °C. | Weight Gain, gm/in$^2$ |
|---|---|---|
| 21 | 1025 | .00064 |
| 79 | 1030 | .0019 |
| 153 | 1025 | .0029 |
| 357 | 1025 | .0051 |
| 539 | 1025 | .0059 |
| 746 | 1025 | .0070 |
| 953 | 1025 | .0079 |
| 1352 | 1025 | .0094 |
| 1836 | 1025 | .0107 |
| 2455 | 1025 | .0129 |

Test No. 16

The coating in this test comprised one coating undiluted (85%) phosphoric acid. The weight of the calcined coating was 0.0034 gm/in$^2$. The results are shown below:

| Minutes on Test | Temperature °C. | Weight Gain, gm/in$^2$ |
|---|---|---|
| 9 | 1050 | .00022 |
| 47 | 1025 | .00080 |
| 102 | 1025 | .0015 |
| 159 | 1025 | .0019 |
| 256 | 1025 | .0023 |
| 627 | 1025 | .0035 |

Test No. 17

The test piece in this test had no coating at all. The results are shown below:

| Minutes on Test | Temperature °C. | Weight Gain, gm/in$^2$ |
|---|---|---|
| 17 | 1030 | .0037 |
| 48 | 1030 | .0060 |
| 119 | 1025 | .0088 |
| 199 | 1025 | .0106 |
| 296 | 1035 | .0122 |
| 443 | 1025 | .0133 |
| 620 | 1025 | .0121 |

The data from the tests are displayed as log-log plots. The significance of the log-log plot is that if the rate of weight gain is inversely proportional to the weight already gained, the weight gained will be proportional to the square root of the time on test, and the log-log plot will have a slope of 0.5. If all of the resistance to oxidation resides in the initial calcined coating, and this resistance is constant and does not increase with time, the weight gained will be directly proportional to the time. Then the plot will have a slope of 1.0. The slopes generated by these data fall between 0.5 and 1.0.

The data for Tests 1, 2, 3, and 4 are plotted in FIG. 1. It is clear that the resistance to oxidation of the coating has an effect. Tests 3 and 4 are close duplicates, with coatings that contain only phosphoric acid. Their data coincide closely, as expected. The coating for Test 2 contained alumina. The curve for Test 2 starts out below the curve for phosphoric acid only, but rises to intersect the phosphoric acid only curve at 483 minutes.

Figure 2:
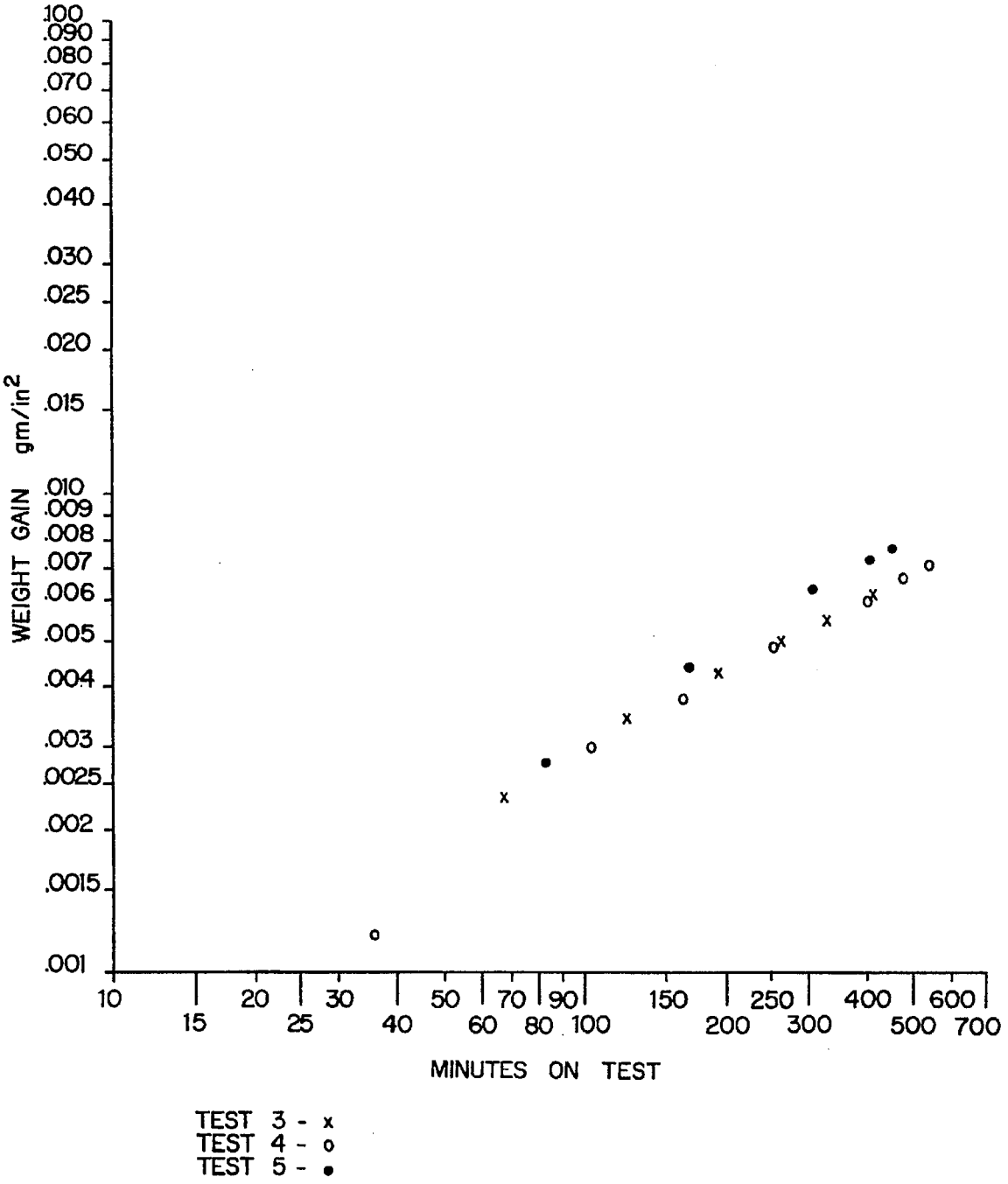
Figure 3:
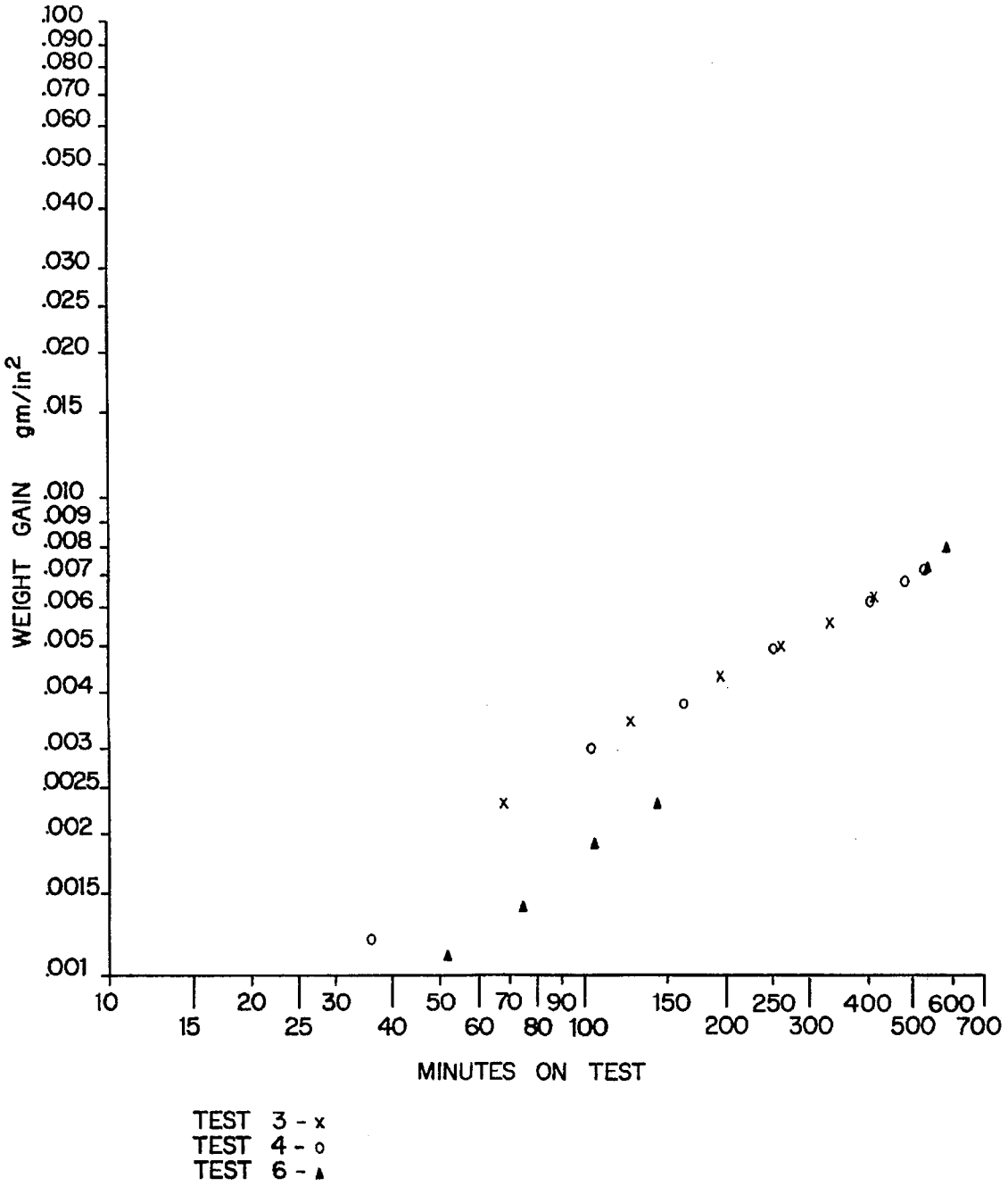

The data for Test 5 are plotted in FIG. 2 which also shows the combined curve for Tests 3 and 4. In all three tests the coating contained only phosphoric acid. The teaching here is that the higher weight of the coating in Test 5 is not beneficial. The data for Test 6 with a coating of phosphorous acid ($H_3PO_3$) are plotted in FIG. 3, which also shows the combined curve for Tests 3 and 4. A coating of phosphorous acid does reduce the reactivity of the aluminide.

Figure 4:
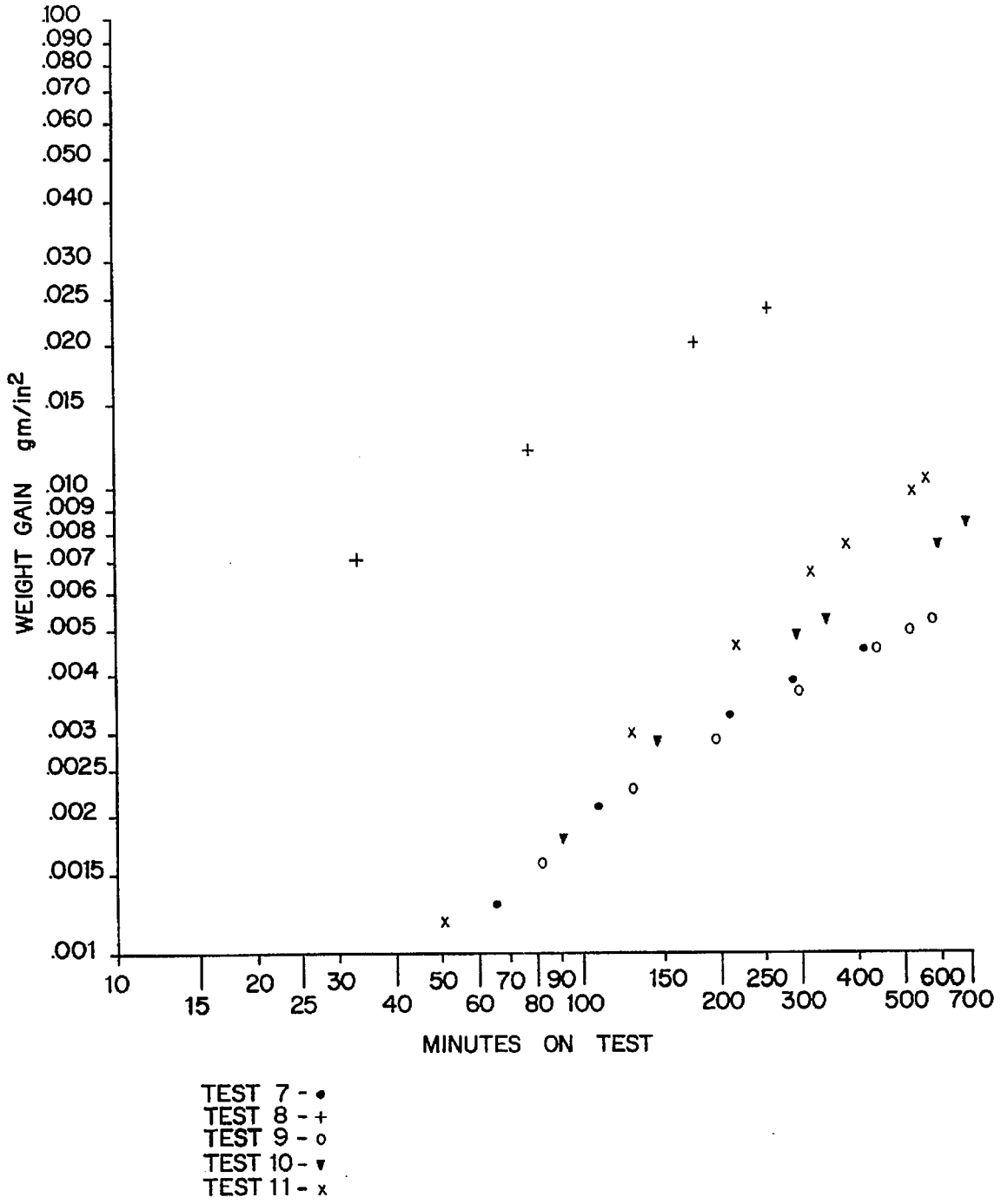

The data for Tests 7, 8, 9, 10 and 11 are plotted in FIG. 4. The test piece in Test 8 has no coating at all, and the weight gain is about 8 times that of the coated pieces. This effect of the treatment according to the present invention was seen before in FIG. 1. Tests 7 and 9 are almost duplicates, so their points fall close together. The treatment of the aluminide done in Test 10 is less effective, possibly because of the higher weight of the coating. The effect of a heavy coating was seen before in Test 5. In Test 11 the test piece was oxidized in air before the phosphoric acid was applied. The oxide so formed increased the weight of the coating and reduced the effectiveness of the treatment according to the present invention.

In Test 12 the test piece was boiled in dilute nitric acid before the phosphoric acid was applied. There is no need to plot the data for Test 12 because they fall on the same curve as Tests 3 and 4.

Figure 5:
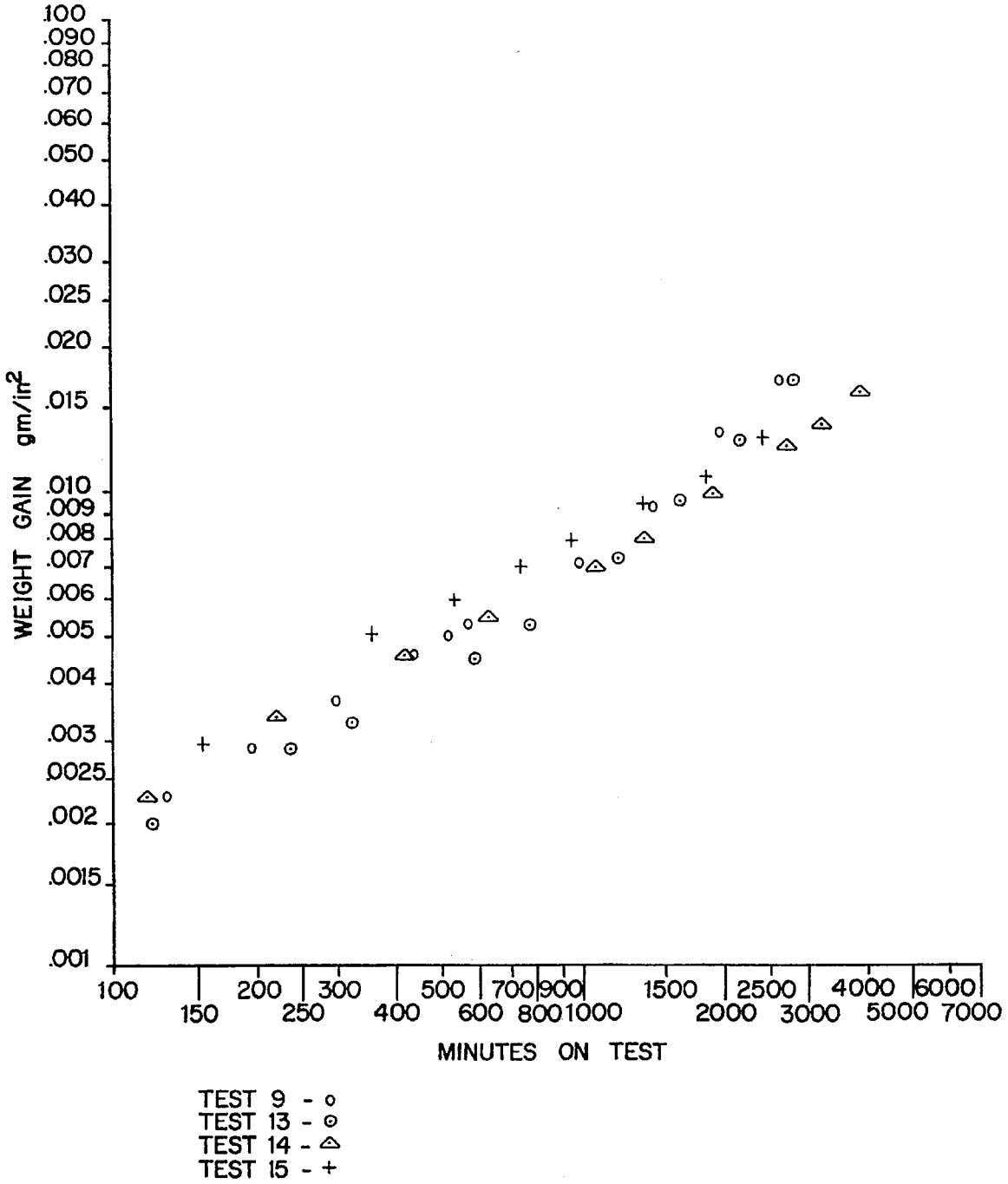

The data for Test 9 are replotted in FIG. 5 along with the data for Tests 13, 14, and 15. In Tests 13, 14, and 15, the coating contained nitric along with phosphoric acid. The teaching here is that the nitric acid has no significant effect.

Figure 6:
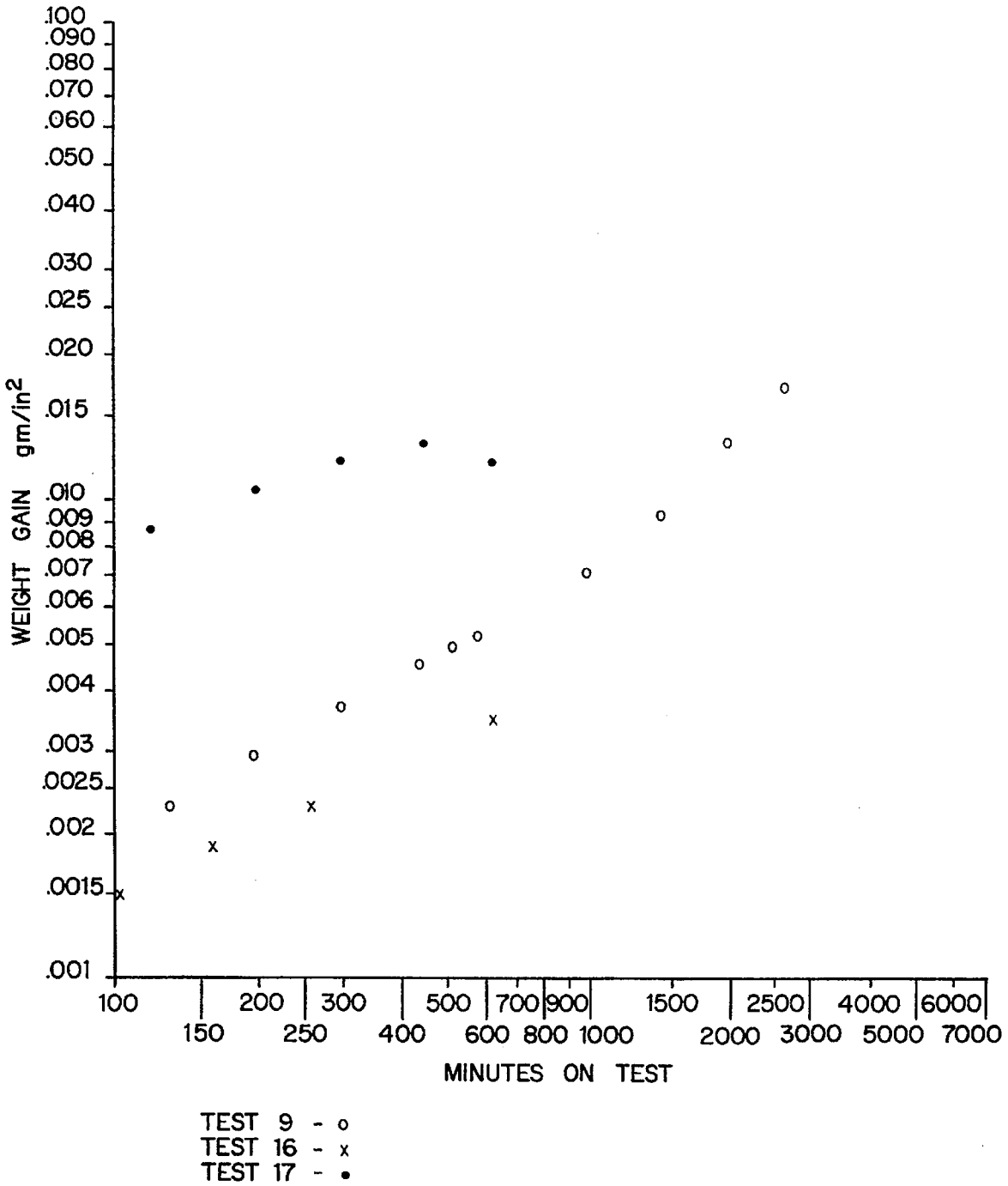

The data from Test 9 are replotted in FIG. 6 along with the data from Tests 16 and 17. The curve for Test 16 falls well below the curve for Test 10. In retrospect, this is because the composition of the test piece for Test 16 is different from the composition of the other test pieces; the test piece in Test 16 is more resistant to oxidation. For Test 17, the test piece of Test 16 was grit blasted clean and retested with no coating at all. Here again the effectiveness of the treatment according to the present invention is apparent. At 443 minutes in Test 17, the oxide coating began the flake off, which reduced the measured weight gain. There was no flaking in Test 16, with the coating of phosphoric acid. The color of the oxide coating formed in Test 17 was different from the color formed on the other test pieces. This is the reason for believing that there was a difference in composition.

While the above examples involve the use of phosphoric acid or phosporous acid, solutions of other phosphate precursors, such as ammonium phosphate, could be used in the present invention.

Other modifications will be apparent to those skilled in the art, and such modifications should be considered within the spirit and scope of the following claims.

What is claimed is:

1. A metallic product usable in high-temperature environments, the product being made by the steps of selecting an aluminide, applying a substance selected from the group consisting of phosphoric acid and phosphorous acid to the aluminide to form a coating on the aluminide, and calcining the coating.

2. The product of claim 1, wherein the aluminide is gamma aluminide, TiAl.

3. The product of claim 1, wherein the aluminide is alpha aluminide, $Ti_3Al$.

4. The product of claim 1, wherein the aluminide is nickel aluminide, $Ni_3Al$.

5. The product of claim 1, wherein the aluminide is nickel aluminide, NiAl.

6. The product of claim 1, wherein the weight of the calcined coating is from about 0.003 to about 0.006 gm per square inch.

7. The product of claim 1, wherein the coating is applied as a single coating.

8. The product of claim 1, wherein the calcining step is preceded by the step of drying the coating.

9. The product of claim 8, wherein the drying step is performed at about 150° C., and wherein the calcining step is performed at a temperature of at least about 500° C.

10. The product of claim 1, wherein the coating step is preceded by the step of cleaning the aluminide.

11. The product of claim 10, wherein the cleaning step comprises the step of grit blasting the aluminide.

12. A method of making an aluminide suitable for use in high-temperature environments, the method comprising the steps of selecting an aluminide, applying a substance selected from the group consisting of phosphoric acid and phosphorous acid to the aluminide to form a coating on the aluminide, and calcining the coating.

13. The method of claim 12, wherein the selecting step comprises selecting the aluminide to be gamma aluminide, TiAl.

14. The method of claim 12, wherein the selecting step comprises the step of selecting the aluminide to be alpha aluminide, $Ti_3Al$.

15. The method of claim 12, wherein the selecting step comprises the step of selecting the aluminide to be nickel aluminide, $Ni_3Al$.

16. The method of claim 12, wherein the selecting step comprises the step of selecting the aluminide to be nickel aluminide, NiAl.

17. The method of claim 12, wherein the coating step is performed such that the weight of the calcined coating is from about 0.003 to about 0.006 gm per square inch.

18. The method of claim 12, wherein the coating step comprises the step of applying a single coating.

19. The method of claim 12, wherein the calcining step is preceded by the step of drying the coating.

20. The method of claim 19, wherein the drying step is performed at about 150° C., and wherein the calcining step is performed at a temperature of at least about 500° C.

21. The method of claim 12, wherein the coating step is preceded by the step of cleaning the aluminide.

22. The method of claim 21, wherein the cleaning step comprises the step of grit blasting the aluminide.

* * * * *